United States Patent [19]

Koppen et al.

[11] 4,398,676

[45] Aug. 16, 1983

[54] TRANSFER TAIL WINDING DEVICE FOR TANDEM WINDUPS

[75] Inventors: Johannes E. A. Koppen, Dordrecht, Netherlands; Samuel E. Workman, Wilmington, Del.

[73] Assignee: E. I. Du Pont de Nemours and Company, Wilmington, Del.

[21] Appl. No.: 328,111

[22] Filed: Dec. 7, 1981

[51] Int. Cl.[3] ..... B65H 54/02; B65H 54/20

[52] U.S. Cl. ..... 242/18 A; 242/18 PW; 242/35.5 R

[58] Field of Search ..... 242/18 A, 18 PW, 18 DD, 242/35.5 R

[56] References Cited

U.S. PATENT DOCUMENTS

| | | | |
|---|---|---|---|
| 3,342,428 | 9/1967 | Smiley, Jr. | 242/18 A |
| 3,409,238 | 11/1968 | Campbell et al. | 242/18 A |
| 3,907,217 | 9/1975 | Graf et al. | 242/18 PW |
| 3,940,075 | 2/1976 | Lenk | 242/18 PW |
| 4,069,984 | 1/1978 | Klink et al. | 242/18 A X |
| 4,154,411 | 5/1979 | Kamp et al. | 242/35.5 R |

FOREIGN PATENT DOCUMENTS

| | | |
|---|---|---|
| 7111681 | 3/1972 | Netherlands . |
| 1477123 | 6/1977 | United Kingdom . |

*Primary Examiner*—Stanley N. Gilreath

[57] ABSTRACT

Yarn winding apparatus having a pair of windups one above the other. A pair of rotatable package supports for each windup are alternately movable into surface driven engagement with a drive roll. During winding packages contact the drive roll until full. In doffing, an empty package contacts the drive roll; the yarn breaks from the full package to engage the empty package. A guide plate is rotated in contact with the yarn to lift it from the traverse guides and direct it to a location outside the path of travel of the traverse guides where a transfer tail is wound.

3 Claims, 4 Drawing Figures

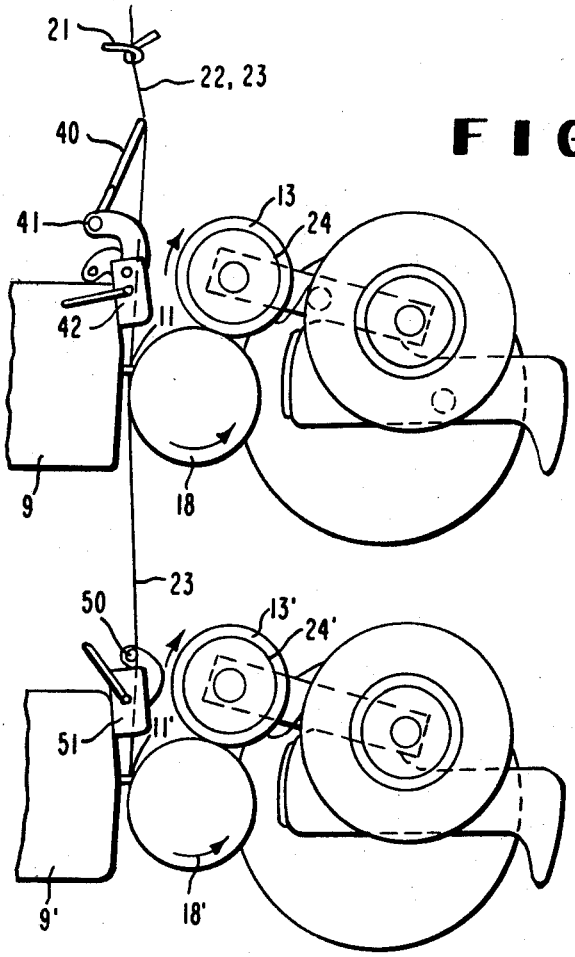
FIG. 2
FIG. 4
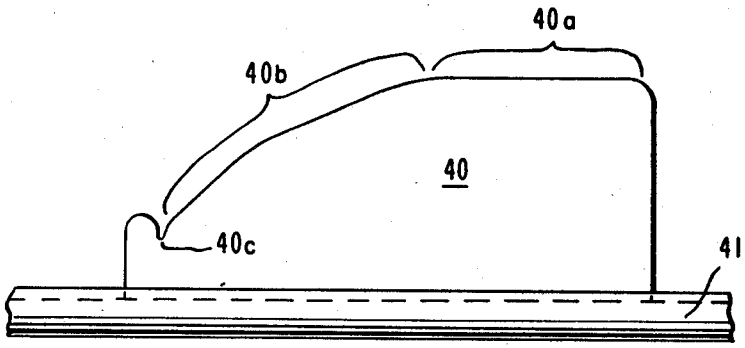

TRANSFER TAIL WINDING DEVICE FOR TANDEM WINDUPS

BACKGROUND OF THE INVENTION

This invention relates generally to the packaging of yarns and more particularly, to an apparatus for winding a controlled length of yarn in advance of the primary yarn package on tandem windups, one above the other.

In the initiation of a fresh package on an empty yarn package support it is usually desirable to provide a short winding or "transfer tail" isolated from the main winding which is freely available for tying to the outer end of yarn on another package when rewinding or otherwise processing yarn.

Although devices for applying transfer tails are known for single windups, they are less than satisfactory when the arrangement shown in FIG. 7 of Campbell et al. U.S. Pat. No. 3,409,238 is used in which one windup assembly is placed above another as would be desirable for winding a large number of threadlines from a single spinning cell. Campbell et al. U.S. Pat. No. 3,409,238 is incorporated herein by reference.

SUMMARY OF THE INVENTION

This invention provides an improved transfer tail winder for use with tandem windups in which one windup is placed above another and one transfer tail winder is used for both windups. The transfer tail device comprises a flat guide plate with a contoured outer peripheral edge terminating in a notch that directs both threadlines to be wound to a predefined location on new package supports outside the main winding to form a transfer tail on each package support.

The winding apparatus has a pair of windups, one above the other, each windup includes a drive roll, a pair of rotatable package supports alternately movable into surface driven engagement with the drive roll, a yarn source, self threading traverse guides through which yarn advances as packages are wound on said supports, and centering guide means positioned above the windups to direct yarn to the approximate center of the package supports when the yarn is released from the traverse guides. The yarn is capable of adhering to the surface of a package support to initiate a new package. The transfer tail device comprises a flat guide plate positioned between said centering guide and the traverse guide associated with the upper one of the windups, and means mounting the guide plate for pivotal movement from a position out of contact with the yarn to a yarn engaging position in which the guide plate releases the yarn from the traverse guide associated with the upper windup. The guide plate has an outer peripheral edge around which the yarn traverses to a location outside the path of travel of the traverse guides when the yarn is engaged by the guide plate; and means for releasing the yarn from the traverse guide associated with the other lower windup.

BRIEF DESCRIPTIONS OF THE DRAWINGS

FIG. 2 is an end elevation view of the apparatus of this invention showing a portion of the tandem windup.

FIG. 4 is an enlarged view of the guide plate of this invention.

DETAILED DESCRIPTION OF THE PREFERRED EMBODIMENT

Figure 1:
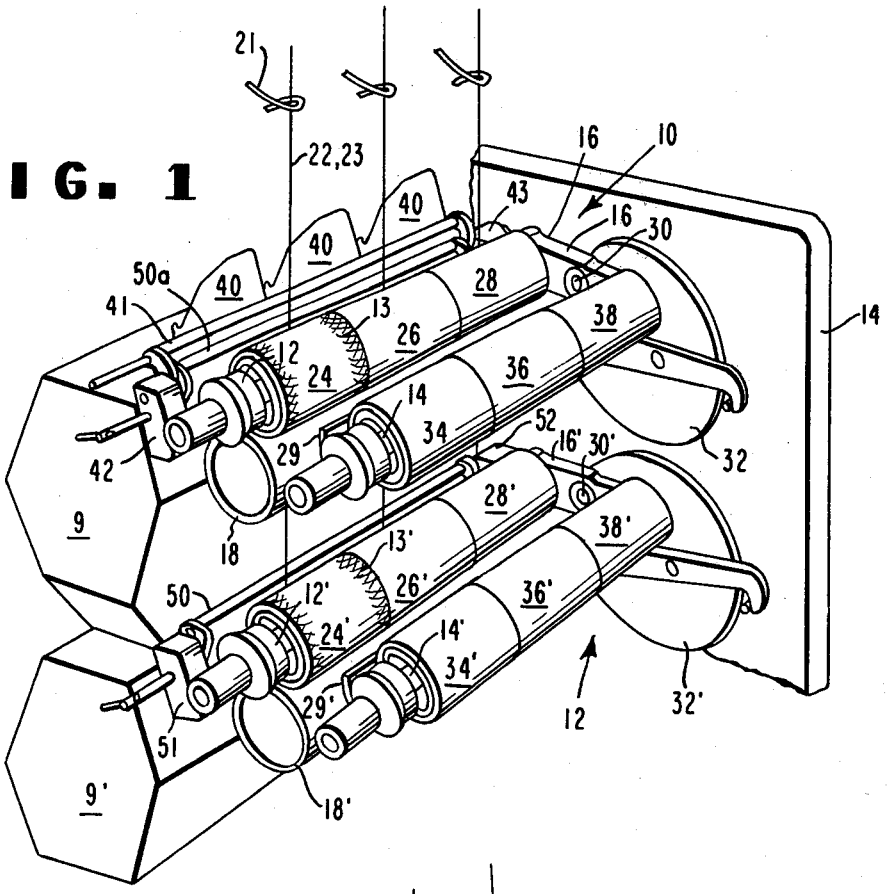
FIG. 1 is a perspective view of a plurality of windups in tandem one above the other on a single frame into which one embodiment of the transfer tail device of this invention has been incorporated.
Figure 3:
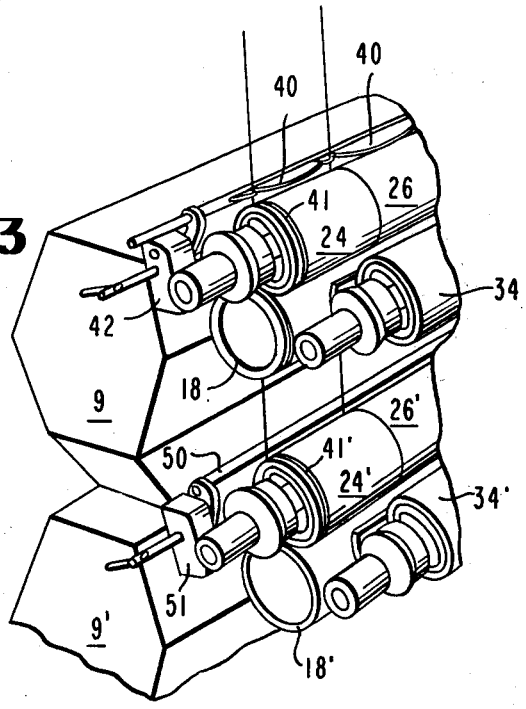
FIG. 3 is a partial front elevation view in perspective revealing formation of a transfer tail with the apparatus of this invention on each windup of the tandem.

The yarn winding apparatus chosen for purposes of illustration includes two windups generally designated 10, 12, disposed vertically one above the other on a frame 14 upon which (referring to the upper windup) is a rotatable cylindrical plate 32, a power driven drive roll 18, and a mechanism 9 which drives a self threading traversing guide 11 in close proximity to the drive roll 18. Situated in the upper left-hand quadrant of plate 32 is a shaft 30 upon which is journalled a pivot arm 16 which extends symmetrically on opposite sides of shaft 30 and carries chucks 12, 14 respectively at its ends.

The chucks 12, 14 are of conventional design and support a plurality of bobbins or package supports 24, 26, 28 (on chuck 12) 34, 36, 38 (on chuck 14). The same parts on the lower windup are designated with the same number of their counterparts on the upper windup only primed.

One detent (not shown) at each end of the pivot arm 16 is adapted to engage a single recess (not shown) in the face of cylindrical plate 32 thus locking arm 16 and plate 32 together temporarily in the position shown in FIG. 1 of Campbell et al.

The description of the function and operation of the plate 32, arm 16 and the shield 29 is disclosed by Campbell et al. U.S. Pat. No. 3,409,238 at column 3, lines 26–57.

Yarn threadlines 22, 23 travel from a source (not shown) vertically downward through centering guide 21 through traverse guide 11. Threadline 22 is directed to a package 13 on bobbin 24. The threadline 23 then continues through traverse 11' on the lower windup to package 13' on bobbin 24'.

In general, the transfer tail device for the tandem upper and lower windups 10, 12 includes two main components, a flat polygonal plate 40 positioned between the centering guide 21 and the traverse guide 11 and a rod 50 extending lengthwise of the lower windup and positioned above traverse guide 11'.

A plurality of plates 40 (depending on the number of winding positions) are mounted in rod 41 which is journalled for pivotal movement in blocks 42, 43, mounted on mechanism 9. The pivotal movement of guides 40 is from a position out of contact with the yarn to a position engaging the yarn in which the peripheral edge **40*a* of the guide contacts the yarn threadlines 21, 23 and releases them from traverse guide 11**.

In a similar fashion, rod 50 is mounted for pivotal movement in blocks 51, 52 mounted on mechanism 9'. In the yarn engaging position, rod 50 releases yarn threadline 23 from traverse guide 11' to defeat the traversing action of the yarn.

The guide plate 40 includes a yarn-restraining notch **40*c*** at one side of the peripheral edge of the guide plate. This maintains the filaments in a coherent bundle during the initial startup and throughout the formation of the transfer tail.

To form a transfer tail before the start of an actual package, empty package supports 34, 36, 38 are brought up to speed by contact with drive roll 18 then full packages 13, 13' are rotated from the winding to the doffing position as the new package supports are simultaneously rotated into winding position. The full packages are slowed down and the yarns 21, 23 which adhere to the surfaces of the new package supports are drawn around and into the nip formed between drive roll 18 and the new package supports. As the winding begins on the new package supports, the guide plate 40 and the rod 50 are rotated into the yarn engaging position and the threadlines 21, 23 are removed from the traverse guides 11, 11'. As the threadlines come in contact with length **40*b* of guide plate 40 which is inclined toward notch 40*c* they are traversed along length 40*b* to notch 40*c*. While the yarn threadlines 21, 23 ride in notch 40*c* a transfer tail is wound on new package supports 34, 34'. At completion of the transfer tails the guide plate 40 and the rod 50 are rotated out of engagement with the yarn. At this instant the yarns flip off the guide plate 40 to a position where they are picked up by the traverse guides 11, 11'** and new packages are begun.

It is to be understood that activation of the transfer tail device mechanism may be accomplished manually or by pneumatic, electrical or mechanical means.

The particular advantage of the invention resides in that the guide plate 40 is very simple designwise and a single guide plate can readily be used to provide transfer tails for two new packages on a tandem windup, one above the other when transferring yarns during doff from a full to an empty package.

While the above description applies to a doffing cycle during continuous operation of the spinning cell, the procedure and apparatus used is somewhat different during initial startup of the spinning cell. More particularly, a traverse defeat rod **50*a*, which is mounted for independent pivotal movement in the same blocks 42, 43 as is rod 41, is used to release the threadlines from traverse guide 11 and the guide plate 40** is not used.

We claim

1. In a winding apparatus having a pair of windups, one above the other; each windup including a drive roll, a pair of rotatable package supports alternately movable into surface driven engagement with the drive roll, a yarn source, and a self threading traverse guide through which yarn advances as packages are wound on said supports, said yarn being capable of adhering to the surface of a package support to initiate a new package; a centering guide means positioned above the windups to direct a yarn to the approximate center of the package support of each windup in surface driven engagement with its respective drive roll when the yarn are released from the traverse guides; a transfer tail device comprising a flat guide plate positioned between said centering guide and the traverse guide associated with the uppermost of said windups means mounting said guide plate for pivotal movement from a position out of contact with said yarns to a yarn engaging position in which the guide plate releases the yarns from the traverse guide associated with the uppermost of said windups, said guide plate having an outer peripheral edge around which the yarns traverse, to a location outside the path of travel of the traverse guides when the yarns are engaged by the guide plate; and means for releasing the yarn from the traverse guide associated with the lowermost of said windups.

2. The winding apparatus as defined in claim 1, wherein the peripheral edge of said guide plate has a notch therein in alignment with said location outside the path of travel of the traverse guides.

3. The winding apparatus as defined in claim 1, wherein said means for releasing the yarn from the traverse guide associated with the lowermost of said windups is a rod extending lengthwise of the package support and above said traverse guide of said lowermost windup, said rod being mounted for pivotal movement from a position out of contact with the yarn to a yarn engaging position in which the rod releases the yarn from said traverse guide of said lowermost windup.

* * * * *